US009718162B2

(12) United States Patent
Jung et al.

(10) Patent No.: US 9,718,162 B2
(45) Date of Patent: Aug. 1, 2017

(54) COMPRESSION LINE SPRING GRINDING DEVICE

(71) Applicant: DAE WON KANG UP CO., LTD., Seoul (KR)

(72) Inventors: Chan-Gi Jung, Incheon (KR); Ui-Seuk Yoon, Gyeonggi-do (KR)

(73) Assignee: DAE WON KANG UP CO., LTD., Seoul (KR)

( * ) Notice: Subject to any disclaimer, the term of this patent is extended or adjusted under 35 U.S.C. 154(b) by 84 days.

(21) Appl. No.: 14/759,745

(22) PCT Filed: Apr. 17, 2013

(86) PCT No.: PCT/KR2013/003210
§ 371 (c)(1),
(2) Date: Jul. 8, 2015

(87) PCT Pub. No.: WO2014/171566
PCT Pub. Date: Oct. 23, 2014

(65) Prior Publication Data

US 2015/0352685 A1 Dec. 10, 2015

(30) Foreign Application Priority Data

Apr. 16, 2013 (KR) ..... 10-2013-0041348

(51) Int. Cl.
*B24B 7/16* (2006.01)
*B24B 7/17* (2006.01)
(Continued)

(52) U.S. Cl.
CPC ..... *B24B 7/167* (2013.01); *B24B 7/17* (2013.01); *B24B 21/008* (2013.01); *B24B 27/0069* (2013.01); *B24B 41/005* (2013.01)

(58) Field of Classification Search
CPC ..... B24B 7/167; B24B 7/17; B24B 21/008; B24B 27/0069; B24B 27/0076; B24B 41/005
See application file for complete search history.

(56) References Cited

U.S. PATENT DOCUMENTS 1,763,820 A * 6/1930 Rodemeyer ..... B24B 7/167 451/261
2,580,542 A * 1/1952 Heath ..... B24B 7/167 451/269
(Continued)

FOREIGN PATENT DOCUMENTS

JP 46-008789 Y 3/1971
JP 05-024621 A 2/1993
(Continued)

*Primary Examiner* — Timothy V Eley
(74) *Attorney, Agent, or Firm* — Rabin & Berdo, P.C.

(57) ABSTRACT

Disclosed herein is an apparatus for grinding a compression line spring. The apparatus includes a lower chain conveyor (100), an upper chain conveyor (200), and grinding units (300). The lower chain conveyor includes chain units each having first support blocks (115) for supporting compression line springs. The upper chain conveyor includes chain units each having second support blocks (215) for compressing downward upper portions of the compression line springs and thus supporting the compression line springs. The grinding units grind seat surfaces formed on opposite ends of the compression line springs that are moved by the upper and lower chain conveyors. A V-shaped depression (115*a*) is formed in each first support block so that each of the compression line springs is seated onto the corresponding V-shaped depression. A lower surface (215*a*) of the second support block that compresses the compression line springs has a planar structure.

11 Claims, 12 Drawing Sheets

(51) Int. Cl.

| | |
|---|---|
| ***B24B 21/00*** | (2006.01) |
| ***B24B 27/00*** | (2006.01) |
| ***B24B 41/00*** | (2006.01) |

(56) References Cited

U.S. PATENT DOCUMENTS

| | | | | | |
|---|---|---|---|---|---|
| RE24,777 | E | * | 2/1960 | Napp | B24B 7/167<br>451/269 |
| 3,393,473 | A | * | 7/1968 | Rimmer | B24B 7/167<br>451/261 |
| 3,844,069 | A | * | 10/1974 | Shank | B24B 7/167<br>451/269 |
| 3,903,651 | A | * | 9/1975 | Suzuki | B24B 53/02<br>451/21 |
| 3,959,931 | A | * | 6/1976 | Shiguma | B24B 7/167<br>451/261 |
| 4,240,231 | A | * | 12/1980 | Day | B23Q 7/035<br>451/184 |

FOREIGN PATENT DOCUMENTS

| | | | |
|---|---|---|---|
| JP | 05-169139 | A | 7/1993 |
| JP | 08-174393 | A | 7/1996 |
| JP | 2000-218485 | A | 8/2000 |
| KR | 10-2002-0052109 | A | 7/2002 |

* cited by examiner

COMPRESSION LINE SPRING GRINDING DEVICE

TECHNICAL FIELD

The present invention generally relates to apparatuses and methods for grinding seat surfaces formed on opposite ends of compression line springs and, more particularly, to an apparatus and method for grinding seat surfaces formed on opposite ends of compression line springs while the compression line springs are continuously transferred by a chain conveyor.

BACKGROUND ART

FIG. 1 is a view showing the structure of a compression line spring.

Generally, the compression line spring 10 is a spring that is manufactured by spirally winding a linear spring material. The compression line spring is processed through a seat-surface grinding process so that seat surfaces 10*a* and 10*b* formed on opposite ends of the compression line spring 10 are oriented perpendicular to a shaft S of the spring 10.

Meanwhile, an apparatus for grinding coil springs was proposed in Japanese Utility Model Registration No. Sho. 46-8789.

FIG. 2 illustrates the construction of the apparatus for grinding coil springs.

The conventional grinding apparatus includes two chains 2 and 4 that are respectively disposed at upper and lower positions, and each of which includes a plurality of supports 5, and whetstones 11 that are disposed on opposite sides of the chains 2 and 4 to grind the opposite ends of the coil springs.

In the conventional grinding apparatus, coil springs are seated on the supports provided in the lower chain, and the coil springs are compressed and fixed in place by the supports provided in the upper chain. Thereafter, the coil springs are moved through the whetstones, whereby seat surfaces formed on the coil springs are ground.

Meanwhile, a V-shaped depression is formed in each of the supports of the upper and lower chains so that the corresponding coil spring can be stably supported by the supports.

However, in the case where two supports each having a V-shaped depression are disposed at upper and lower positions facing each other with a coil spring interposed therebetween, the coil spring may not be stably supported by the supports unless the two supports are accurately aligned with each other.

Therefore, it is required for the conventional grinding apparatus to be precisely processed and set such that the two supports disposed at upper and lower positions facing each other are accurately aligned with each other with a coil spring interposed therebetween. Thus, it is not easy to manufacture, use, and maintain the apparatus.

PRIOR ART DOCUMENT (Patent document 1) Japanese Utility Model Registration No. Sho. 46-8789 (Mar. 29, 1971)

DISCLOSURE

Technical Problem

Accordingly, the present invention has been made keeping in mind the above problems occurring in the prior art, and an object of the present invention is to provide an apparatus and method for grinding compression line springs in which support blocks that are provided in upper and lower chain conveyors to fix the compression line springs in place have an improved structure so that the compression line springs can be stably fixed in place without precisely setting the support blocks and parts related to the support blocks.

Technical Solution

In order to accomplish the above object, in an aspect, the present invention provides an apparatus for grinding a compression line spring, including: a lower chain conveyor including a pair of chain units provided facing each other at positions spaced apart from each other, each of the chain units comprising a plurality of first support blocks for supporting compression line springs; an upper chain conveyor including a pair of chain units provided facing each other at positions spaced apart from each other, each of the chain units comprising a plurality of second support blocks for compressing downward upper portions of the compression line springs seated on the first support blocks and thus supporting the compression line springs; and a plurality of grinding units for grinding seat surfaces formed on opposite ends of the compression line springs that are moved by the lower chain conveyor and the upper chain conveyor. A V-shaped depression is formed in each of the first support blocks so that each of the compression line springs is seated onto the corresponding V-shaped depression. A lower surface of the second support block that compresses downward the upper portions of the compression line springs seated on the first support blocks has a planar structure.

In another aspect, the present invention provides a method for grinding a compression line spring, including: an operation (S101) of adjusting both a distance between a front chain unit and a rear chain unit of the lower chain conveyor and a distance between a front chain unit and a rear chain unit of the upper chain conveyor; an operation (S102) of adjusting a height of the upper chain conveyor depending on an outer diameter of compression line springs; an operation (S110) of seating the compression line springs into V-shaped depressions formed in respective first support blocks provided in the lower chain conveyor, compressing, using planar lower surfaces formed on respective second support blocks provided in the upper chain conveyor, upper portions of the compression line springs seated on the first support blocks and fixing the compression line springs in place, and then transferring the compression line springs in a horizontal direction using the lower chain conveyor and the upper chain conveyor; and an operation (S120) of grinding, using grinding units, seat surfaces formed on opposite ends of the compression line springs that are transferred in the operation (S110).

Advantageous Effects

According to the present invention, even if two support blocks that press compression line springs upward and downward and thus fix the springs in place are misaligned from each other, the compression line springs can be stably fixed in place. Therefore, there is no need for precisely processing or setting parts such as the support blocks and the chain related to the support block.

DESCRIPTION OF THE REFERENCE NUMERALS IN THE DRAWINGS

Figure 1:
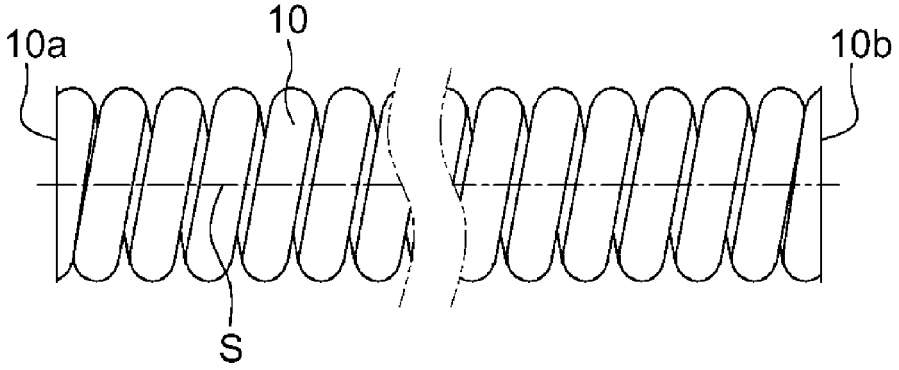
FIG. 1 is a view showing the structure of a compression line spring.
Figure 2:
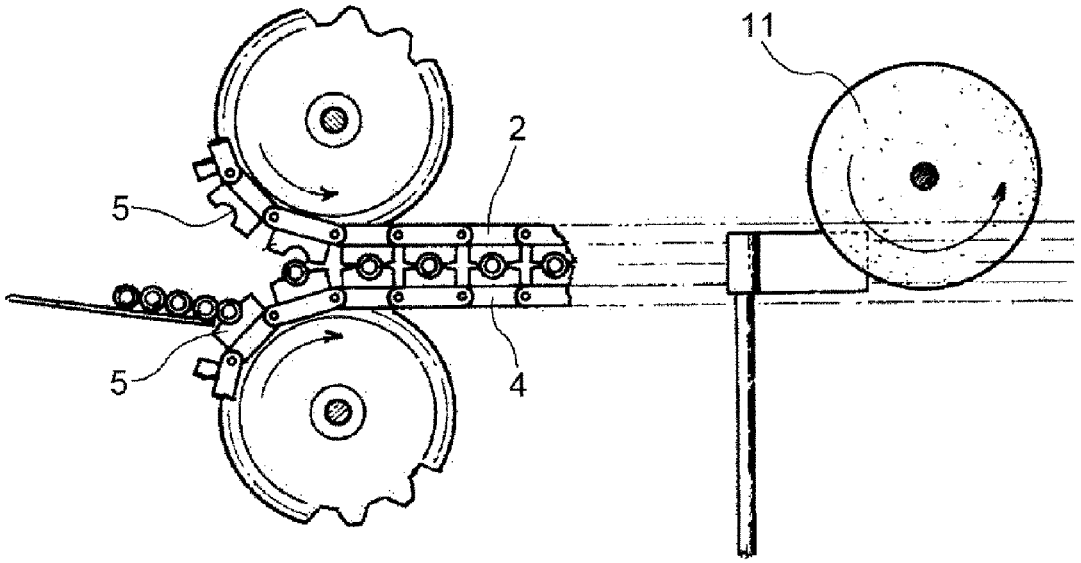
FIG. 2 is a view illustrating the construction of a conventional apparatus for grinding a coil spring.

100: lower chain conveyor 110: front chain unit
110': rear chain unit 115: first support block
118: spline shaft 130,130': first screw shaft
140: transfer nut 150: belt
200: upper chain conveyor 210: front chain unit
210': rear chain unit 214: chain
215: second support block 218: spline shaft
230: second screw shaft 240: transfer nut
250: motor 260: compression block
261: pin 270: spring
300: grinding unit 330; transfer table
340: transfer nut 350: third screw shaft
360: fastening plate 370: transfer nut
380: fourth screw shaft 400: motor
410: reducer 411,412: output shaft
420: first universal joint 430: second universal joint
500: distance adjustment means 510: lift frame
520: rail 531,532: inclined block
531', 532': inclined rail 540: fifth screw shaft
543: handle 551,552: fixed block
560: fixed frame

BEST MODE

Hereinafter, an embodiment of the present invention will be described with reference to the attached drawings. If in the specification detailed descriptions of well-known functions or configurations would unnecessarily obfuscate the gist of the present invention, the detailed descriptions will be omitted.

Figure 3:
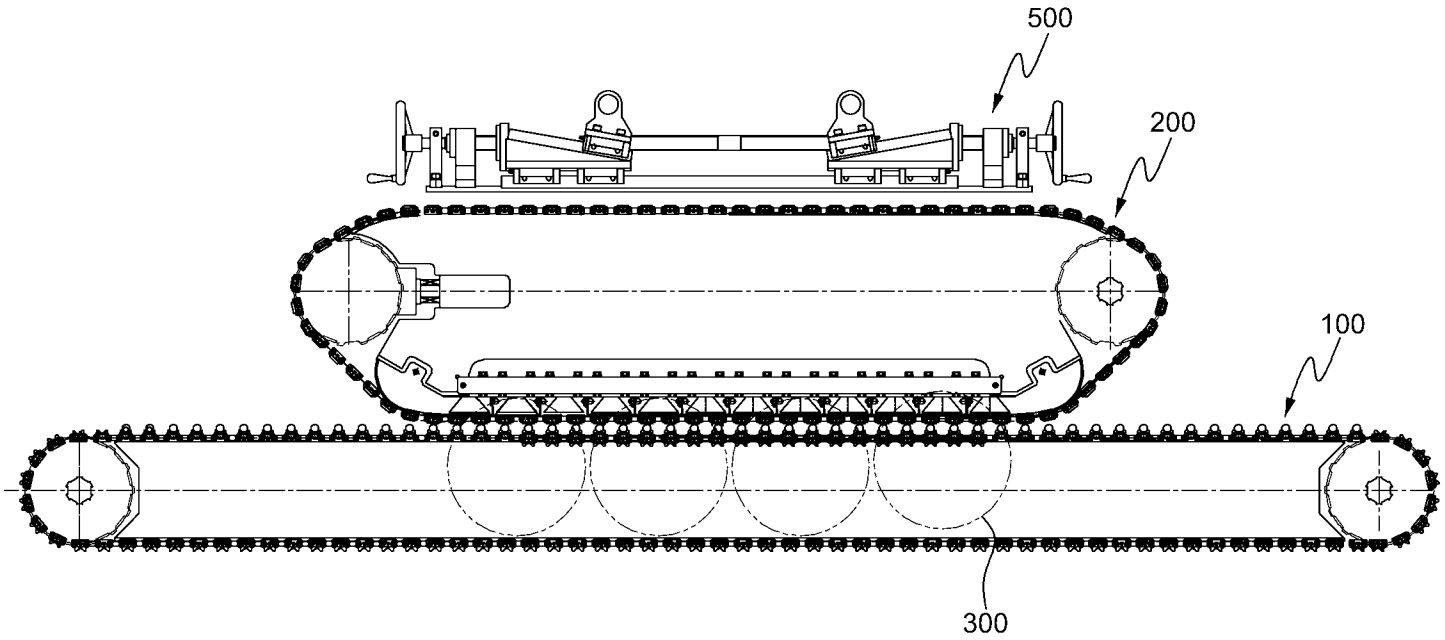
FIG. 3 is a front view illustrating the critical construction of a grinding apparatus according to the present invention.
Figure 4:
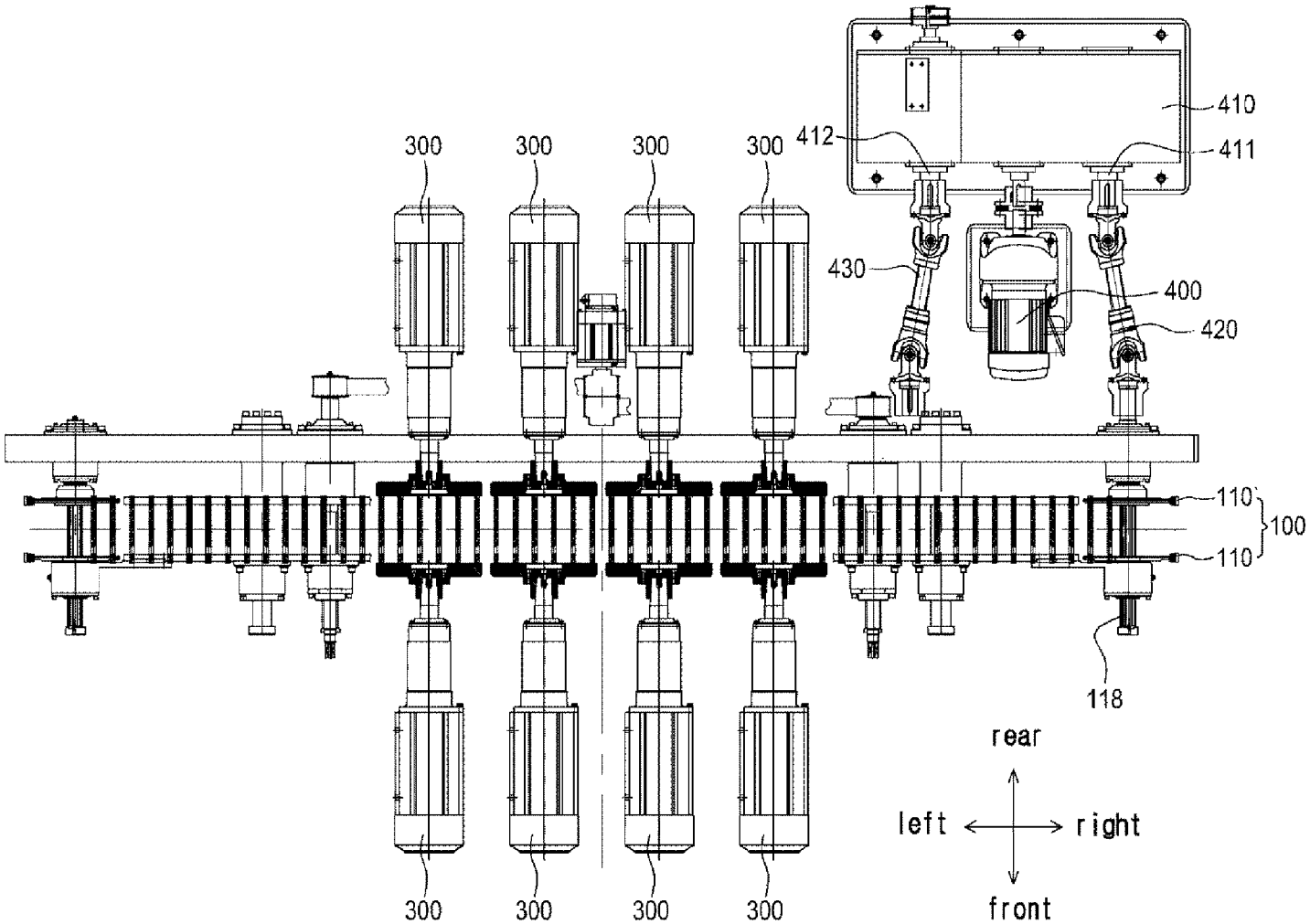
FIG. 4 is a plan view illustrating the critical construction of the grinding apparatus according to the present invention.
Figure 5:
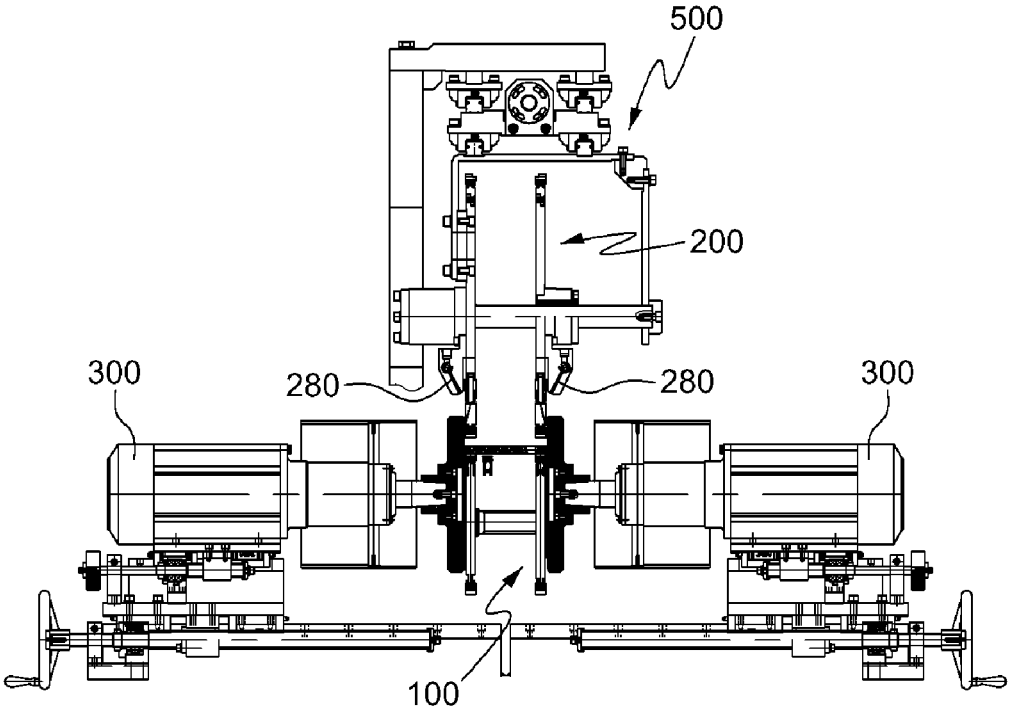
FIG. 5 is a side view illustrating the critical construction of the grinding apparatus according to the present invention.

FIG. 3 is a front view illustrating the critical construction of a grinding apparatus according to the present invention. FIG. 4 is a plan view illustrating the critical construction of the grinding apparatus according to the present invention. FIG. 5 is a side view illustrating the critical construction of the grinding apparatus according to the present invention.

The apparatus for grinding a compression line spring according to the present invention includes a lower chain conveyor 100, an upper chain conveyor 200, and grinding units 300.

Reference numeral 280 of FIG. 5 denotes a nozzle that sprays cutting oil to cool heat generated during a process of grinding the compression line spring and prevents dust from scattering.

Figure 6:
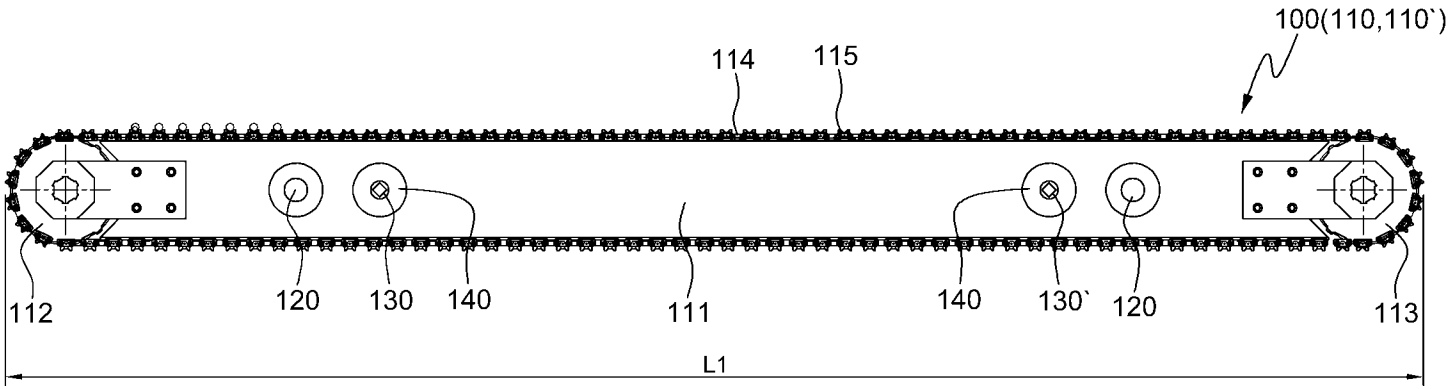
FIG. 6 is a front view illustrating the construction of a lower chain conveyor according to the present invention.
Figure 7:
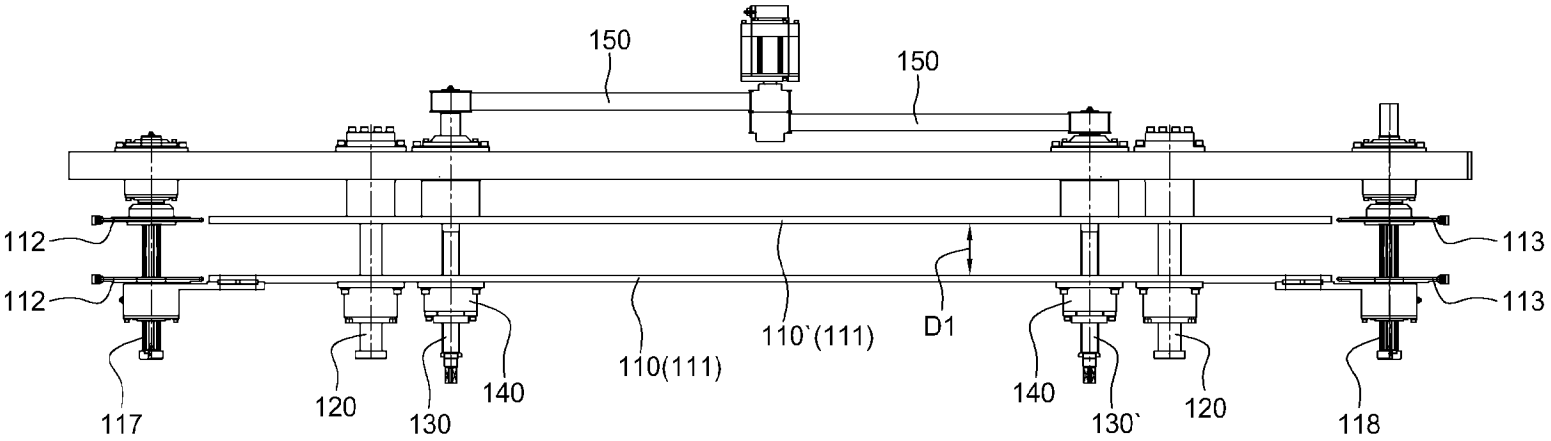
FIG. 7 is a plan view illustrating the construction of the lower chain conveyor according to the present invention.
Figure 8:
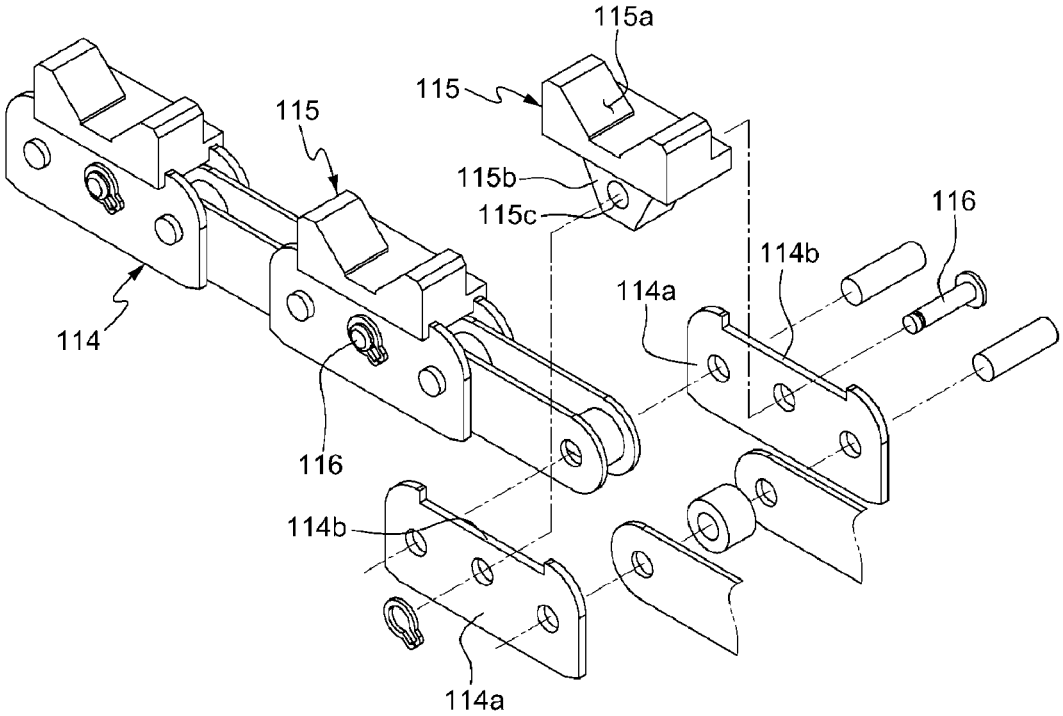
FIG. 8 is a perspective view showing the coupling of first support blocks to a chain according to the present invention.

FIG. 6 is a front view illustrating the construction of the lower chain conveyor according to the present invention. FIG. 7 is a plan view illustrating the construction of the lower chain conveyor according to the present invention. FIG. 8 is a perspective view showing the coupling of first support blocks to a chain according to the present invention.

The lower chain conveyor 100 includes a pair of chain units 110 and 110'. The chain units 110 and 110' are disposed facing each other at positions spaced apart from each other.

Meanwhile, the two chain units 110 and 110' substantially have the same construction with a difference only in position; therefore, the same reference numerals are used to explain parts of the chain units 110 and 110'.

Each chain unit 110, 110' includes a frame 111, sprockets 112 and 113 installed on respective opposite left and right ends of the frame 111, a chain 114 that is supported by the frame 111 and the sprockets 112 and 113 and rotated therearound, and a plurality of first support blocks 115 that is installed on the chain 114 and provides space to seat the compression line springs therein.

The sprockets 112 and 113 that are provided in the two chain units 110 and 110' spaced apart from each other are respectively coupled to spline shafts 117 and 118 each of that extends a predetermined length through the two chain units 110 and 110', whereby the sprockets 112 and 113 are rotated along with the spline shafts 117 and 118. Furthermore, the front chain unit 110 disposed at a front side of the apparatus is configured to be movable along the spline shafts 117 and 118 toward or away from the rear chain unit 110'.

Therefore, a distance D1 between the two chain units 110 and 110' can be appropriately adjusted by moving the front chain unit 110 depending on the length of the compression line springs.

To achieve the purpose of moving the front chain unit 110, the front chain unit 110 and the rear chain unit 110' are connected to each other by one or more linear guides 120. The front chain unit 110 is configured to move along the linear guides 120.

The front chain unit 110 includes transfer nuts 140 that are coupled to one or more first screw shafts 130 and 130' which horizontally extend a predetermined length through the rear chain unit 110'. Therefore, the front chain unit 110 is moved along with the transfer nuts 140 by rotation of the first screw shafts 130 and 130'

FIGS. 6 and 7 illustrate the configuration in which the first screw shafts 130 and 130' are respectively installed in the opposite left and right sides of the lower chain conveyor 100. In this embodiment, the first screw shafts 130 and 130' are automatically rotated by a power source such as a motor, but they may be configured to be manually rotated by an operator.

Each first support block 115 has a V-shaped depression 115*a* in an upper surface thereof so that a compression line spring having a predetermined outer diameter can be stably supported by the first support block 115 regardless of the outer diameter of the spring so long as the outer diameter is within a predetermined range. Furthermore, a coupling part 115*b* is provided under a lower surface of the first support block 115 and coupled to chain links 114*a* of the chain 114.

Preferably, the first support block 115 is configured such that, depending both on the orientation of a compression line spring seated on the first support block 115 and on the orientation of a second support block for compressing an upper portion of the compression line spring, the first support block 115 is moved and optimally oriented to support the compression line spring.

For this, each of the chain links 114*a* of the chain 114 to which the first support blocks 115 are coupled has a seating depression 114*b* into which a lower end of the corresponding first support block 115 is partially inserted.

Furthermore, a through hole 115*c* is formed in the coupling part 115*b* of the first support block 115 so that a connection pin 116 is inserted into the through hole 115*c* while passing through the chain links 114*a*. In other words, the first support blocks 115 are coupled to the chain 114 by the connection pins 116 inserted through the side surfaces of the chain links 114*a*.

According to the above construction, each first support block 115 is configured such that it finely rotates around the corresponding connection pin 116 within a range allowed by clearance between the first support block 115 and the chain links 114*a*. That is, the first support block 115 is finely rotated around the connection pin 116 depending both on the orientation of the compression line spring seated onto the first support block 115 and on the orientation of the second support block compressing and supporting an upper end of the compression line spring and is thus oriented corresponding to the orientations of the compression line spring and the second support block. In this way, the first support block 115 can more stably support the compression line spring.

Meanwhile, clearance formed between the first support block 115 and the chain links 114*a* may be clearance that is artificially formed between the first support block 115 and the chain links 114*a* so as to allow for fine movement of the first support block 115 or clearance that is formed by an error caused during manufacture or assembly of the first support block 115 and the chain links 114*a*.

Figure 9:
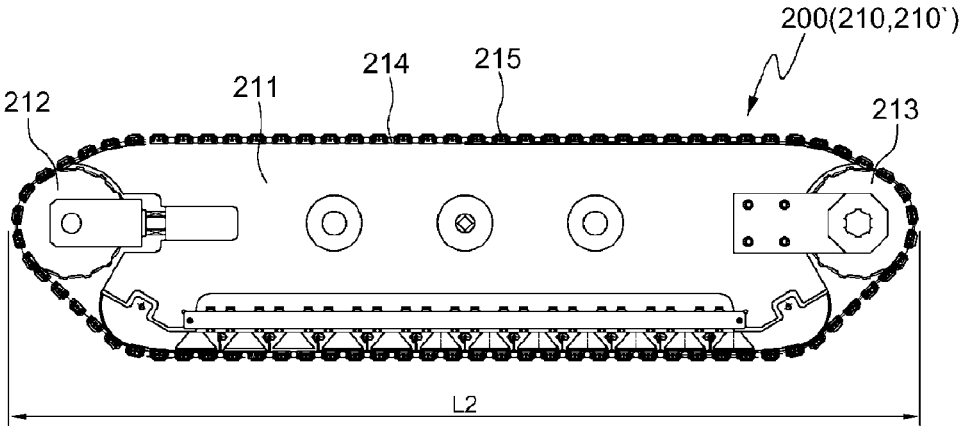
FIG. 9 is a front view illustrating the construction of an upper chain conveyor according to the present invention.
Figure 10:
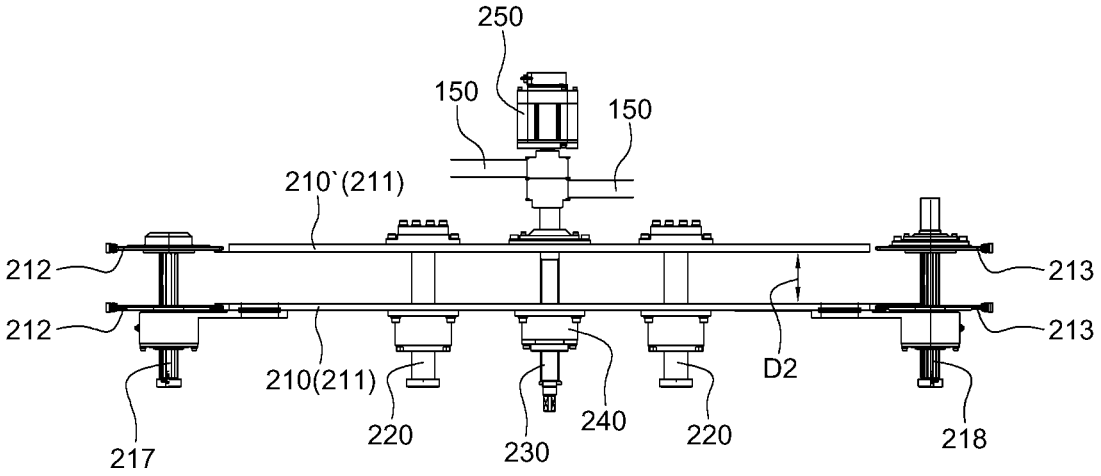
FIG. 10 is a plan view illustrating the construction of the upper chain conveyor according to the present invention.
Figure 11:
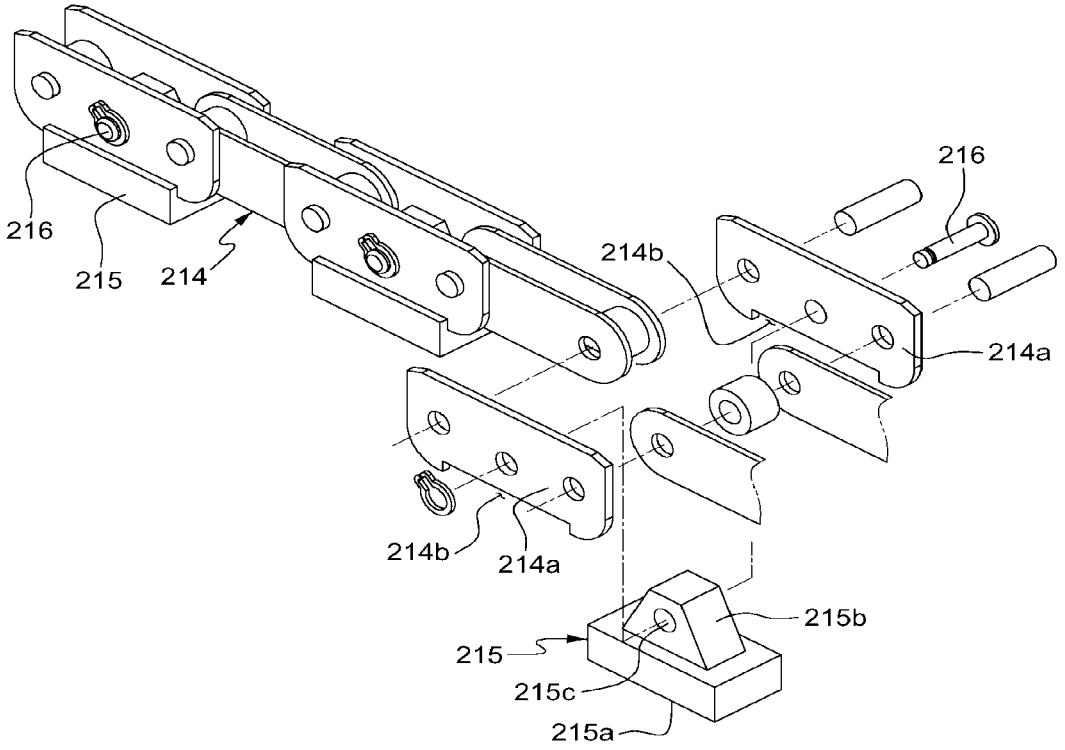
FIG. 11 is a perspective view showing the coupling of second support blocks to a chain according to the present invention.
Figure 12:
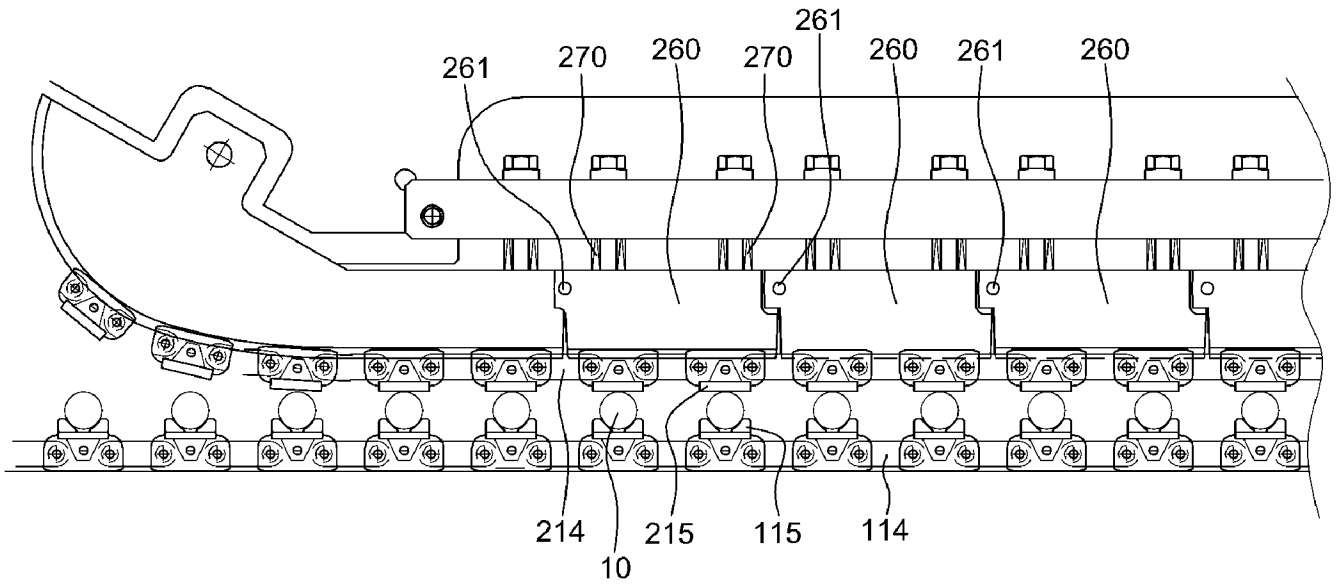
FIG. 12 is a view showing in detail the installation of pressing-blocks according to the present invention.

FIG. 9 is a front view illustrating the construction of an upper chain conveyor according to the present invention. FIG. 10 is a plan view illustrating the construction of the upper chain conveyor according to the present invention. FIG. 11 is a perspective view showing the coupling of second support blocks to a chain according to the present invention. FIG. 12 is a view showing in detail the installation of pressing-blocks according to the present invention.

The upper chain conveyor 200 includes a pair of chain units 210 and 210'. The chain units 210 and 210' are disposed facing each other at positions spaced apart from each other. Preferably, the chain units 210 and 210' are respectively disposed vertically above the chain units 110 and 110' of the lower chain conveyor 100.

According to the above construction, the second support blocks 215 provided in the chain units 210 and 210' of the upper chain conveyor 200 are disposed vertically above the respective first support blocks 115 provided in the chain units 110 and 110' of the lower chain conveyor 100. The first and second support blocks 115 and 215 face each other with the compression line springs interposed therebetween and thus fix the compression line springs in place.

Meanwhile, the two chain units 210 and 210' substantially have the same construction with a difference only in position; therefore, the same reference numerals are used to explain parts of the chain units 210 and 210'.

Each chain unit 210, 210' includes a frame 211, sprockets 212 and 213 installed on respective opposite left and right ends of the frame 211, a chain 214 that is supported by the frame 211 and the sprockets 212 and 213 and rotated therearound, and a plurality of second support blocks 215 that is installed on the chain 214 and compresses and supports the upper portions of the compression line springs seated on the respective first support blocks 115.

Each second support block 215 has a lower surface 215*a* that is planar so that, even when the second support block 215 is not accurately aligned vertically above the corresponding first support block 115, the upper portion of the compression line spring seated on the first support block 115 can be stably pressed and supported by the second support block 215.

Preferably, the second support block 215 is configured such that, depending both on a difference in position between the first and second support blocks 115 and 215 and on the orientation of a compression line spring seated on the first support block 115, the second support block 215 is moved and optimally oriented to support the compression line spring.

For this, each of the chain links 214*a* of the chain 214 to which the second support blocks 215 are coupled has a seating depression 214*b* into which an upper end of the corresponding second support block 215 is partially inserted.

Furthermore, a coupling part 215*b* is provided on an upper surface of the second support block 215 and coupled to chain links 214*a* of the chain 214. A through hole 215*c* is formed in the coupling part 215*b* of the second support block 215 so that a connection pin 216 is inserted into the through hole 215*c* while passing through the chain links 214*a*. In other words, the second support blocks 215 are coupled to the chain 214 by the connection pins 216 inserted through the side surfaces of the chain links 214*a*.

According to the above construction, each second support block 215 is configured such that it finely rotates around the corresponding connection pin 216 within a range allowed by clearance between the second support block 215 and the chain links 214*a*. That is, the second support block 215 is finely rotated around the connection pin 216 depending both on a difference in position between the first and second support blocks 115 and 215 and on the orientation of a compression line spring and thus can be optimally oriented to press the compression line spring downward.

Meanwhile, clearance formed between the second support block 215 and the chain links 214*a* may be clearance that is artificially formed between the second support block 215 and the chain links 214*a* so as to allow for fine movement of the second support block 215 or clearance that is formed by an error caused during manufacture or assembly of the second support block 215 and the chain links 214*a*.

The sprockets 212 and 213 that are provided in the two chain units 210 and 210' spaced apart from each other are respectively coupled to spline shafts 217 and 218 each of which extends a predetermined length through the two chain units 210 and 210', whereby the sprockets 212 and 213 are rotated along with the spline shafts 217 and 218. Furthermore, the chain unit 210 disposed at the front side of the apparatus is configured to be movable along the spline shaft 217 and 218 toward or away from the rear chain unit 210'.

The sprockets 212 that are disposed at the left side of the associated drawing are idle sprockets, which rotate under no-load conditions without being connected to any power source. The sprockets 212 may be coupled to each other by a general shaft rather than by the spline shaft 217.

According to the above-mentioned construction, a distance D2 between the two chain units 210 and 210' can be appropriately adjusted by moving the front chain unit 210 depending on the length of the compression line springs.

To achieve the purpose of moving the front chain unit 210, the front chain unit 210 and the rear chain unit 210' are connected to each other by one or more linear guides 220. The front chain unit 210 is configured to move along the linear guides 220.

Furthermore, the front chain unit 210 includes a transfer nut 240 that is coupled to a second screw shaft 230 that horizontally extends a predetermined length through the rear chain unit 210'. Therefore, the front chain unit 210 is moved along with the transfer nut 240 by rotation of the second screw shaft 230.

Preferably, the second screw shaft 230 and the first screw shafts 130 and 130' are connected and interlocked with each other so that the front chain unit 210 of the upper chain conveyor 200 and the front chain unit 110 of the lower chain conveyor 100 can be moved together.

For this, the first screw shafts 130 and 130' and the second screw shaft 230 are connected to each other by a power transmission means such as chains or belts (150: refer to FIGS. 7 and 10). According to this construction, when the first screw shafts 130 and 130' rotate, the second screw shaft 230 rotates along with the first screw shafts 130 and 130'. In the same manner, when the second screw shaft 230 rotates, the first screw shafts 130 and 130' also rotate along with the second screw shaft 230.

With regard to the interlocking rotation of the first screw shaft 130 and 130' and the second screw shaft 230, the second screw shaft 230 may be connected to a motor 250 and rotated by it so that the two front chain units 110 and 210 can be moved by the operation of the motor 250. Alternatively, the two front chain units 110 and 210 may be moved by manually manipulating the first screw shafts 130 and 130'.

A left-right width (L2: refer to FIG. 10) of the upper chain conveyor 200 is shorter than a left-right width (L1: refer to FIG. 7) of the lower chain conveyor 100.

Preferably, the upper chain conveyor 200 further includes a plurality of compression blocks 260 that press the chain 214 downward so that the second support blocks 215 can reliably come into close contact with the compression line springs, and a plurality of springs 270 that elastically support the compression blocks 260.

The compression blocks 260 are installed under the frames 211 of the chain units 210 and 210'. The compression blocks 260 installed in the above manner are disposed vertically above a portion of the chain 214 that passes under lower ends of the frames 211 and thus compress the chain 214 downward.

Meanwhile, each of the compression blocks 260 compresses the chain 214 downward so that one or two corresponding second support blocks 215 can come into close contact with the respective compression line springs. For reference, FIG. 12 illustrates the structure in which two second support blocks 215 are compressed by a single compression block 260.

The compression blocks 260 are coupled to each other by pins 261. According to this construction, each compression block 260 is configured so as to be restrictively rotatable around the corresponding pin 261, whereby each two of the second support blocks 215 that are compressed by a corresponding single compression block 260 can be compressed even under different conditions.

That is, there may be a deviation in orientation or outer diameter of the compression line springs 10 supported by the first and second support blocks 115 and 215. However, if the second support blocks 215 are compressed at the same pressure without taking such deviation into account, the second support block 215 that is disposed above the compression line spring having a comparatively small diameter may not reliably come into close contact with the upper portion of the compression line spring. In this case, the compression line spring may be removed from its correct position during the process of grinding the seat surfaces of the compression line spring.

However, in the present invention, the compression blocks 260 are coupled to each other by the pins 261, whereby the compression blocks 260 are configured so as to be slightly movable although this movement is restricted. In this case, appropriate movement of the compression blocks 260 compensates for the deviation in orientation or outer diameter of the compression line springs. Consequently, the compression line springs can be more stably supported by the support blocks.

The lower chain conveyor 100 and the upper chain conveyor 200 are operated by power provided from a single motor.

In more detail with reference to FIG. 4, the motor 400 for providing power to operate the lower chain conveyor 100 and the upper chain conveyor 200 is connected to a reducer 410. The reducer 410 reduces the speed of rotation input from the motor 400 at a predetermined ratio and then outputs power reduced in speed via two output shafts 411 and 412. Any one of the two output shafts 411 and 412 provided in the reducer 410 is coupled by a first universal joint 420 to the spline shaft 118 provided in the lower chain conveyor 100. The other output shaft 411 or 412 is coupled by a second universal joint 430 to the spline shaft (218: refer to FIG. 10) provided in the upper chain conveyor 200.

Meanwhile, although the internal construction of the reducer 410 is not illustrated in detail, a plurality of gears are provided in the reducer 410 so as to reduce the speed of rotation input from the motor 400 at a predetermined ratio. Such construction of the reducer 410 is a well known and widely used technique. Therefore, further explanation of the reducer 410 will be omitted.

Figure 13:
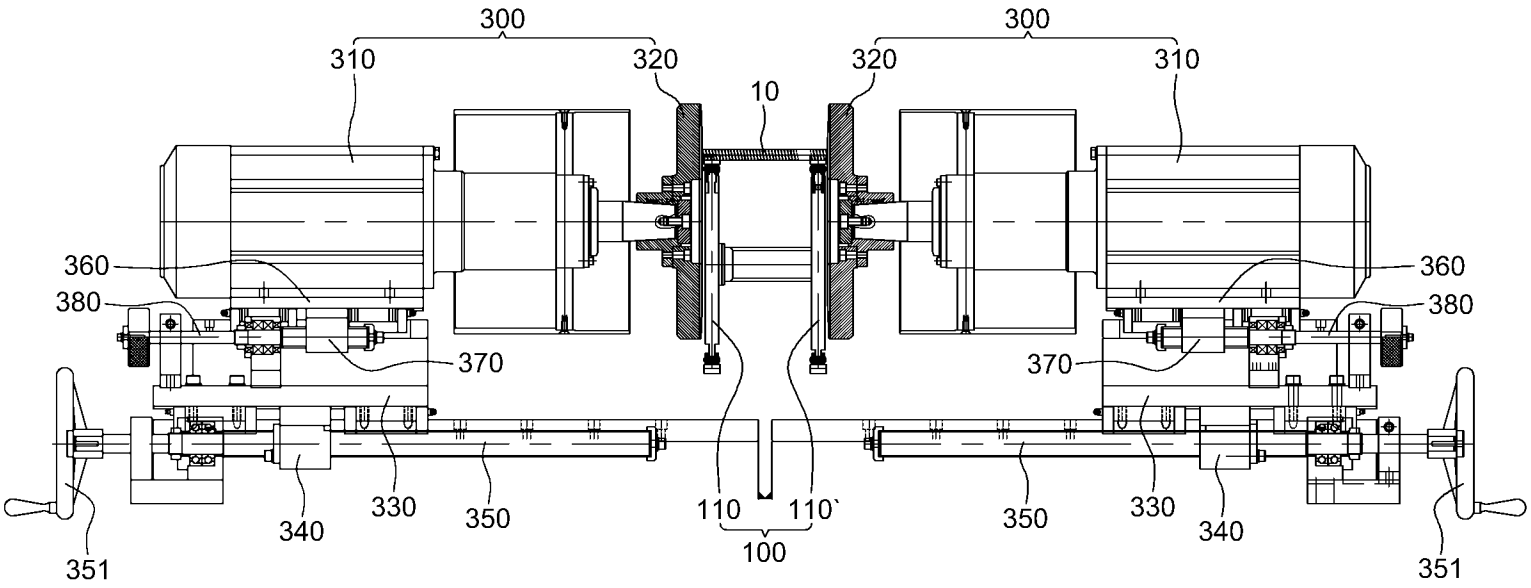
FIG. 13 is a side view showing the installation structure of grinding units according to the present invention.

FIG. 13 is a side view illustrating the installation structure of the grinding units according to the present invention.

The grinding units 300 are disposed on opposite front and rear sides of the lower chain conveyor 100 and grind seat surfaces of opposite ends of the compression line springs 10 that are being moved by the lower chain conveyor 100 and the upper chain conveyor.

Some of the grinding units 300 are disposed ahead of the lower chain conveyor 100, and the other grinding units 300 are disposed behind the lower chain conveyor 100.

Each grinding unit 300 includes a motor 310, and a grinding wheel 320 that is rotated by the motor 310 to conduct the grinding operation.

Preferably, each grinding unit 300 is configured such that an operator can adjust the position thereof depending both on the length of the compression line spring 10 and on the depth of cut. For this, a transfer table 330 is provided under the grinding unit 300, and a transfer nut 340 and a third screw shaft 350 are installed to transfer the transfer table 330.

Meanwhile, the transfer table 330, the transfer nut 340, and the third screw shaft 350 are installed on each of the opposite front and rear sides of the lower chain conveyor 100 so that the grinding units disposed ahead of the lower chain conveyor 100 and the grinding units disposed behind the lower chain conveyor 100 can be independently moved.

The grinding units 300 are fastened on an upper surface of each transfer table 330.

The transfer nut 340 is fastened to a lower surface of the transfer table 330.

The third screw shaft 350 extends in the front-rear direction perpendicular to the lower chain conveyor 100 and is coupled to the transfer nut 340.

When the operator rotates a handle 351 coupled to the third screw shaft 350, the transfer nut 340 is moved by the rotation of the third screw shaft 350. The transfer table 330 is thus moved by the movement of the transfer nut 340, whereby the position of the grinding unit 300 can be adjusted.

Meanwhile, to individually adjust the position of each grinding unit 300, a fastening plate 360 is installed under a lower surface of each grinding unit 300. A transfer nut 370 is provided under a lower surface of the fastening plate 360. A fourth screw shaft 380 is installed on an upper surface of the transfer table 330 and is coupled to the transfer nut 370 so that the transfer nut 370 is moved by rotation of the fourth screw shaft 380.

Preferably, the pitch of the fourth screw shaft 380 is less than that of the third screw 350 so that the position of each grinding unit 300 can be more precisely adjusted by the fourth screw shaft 380.

Figure 14:
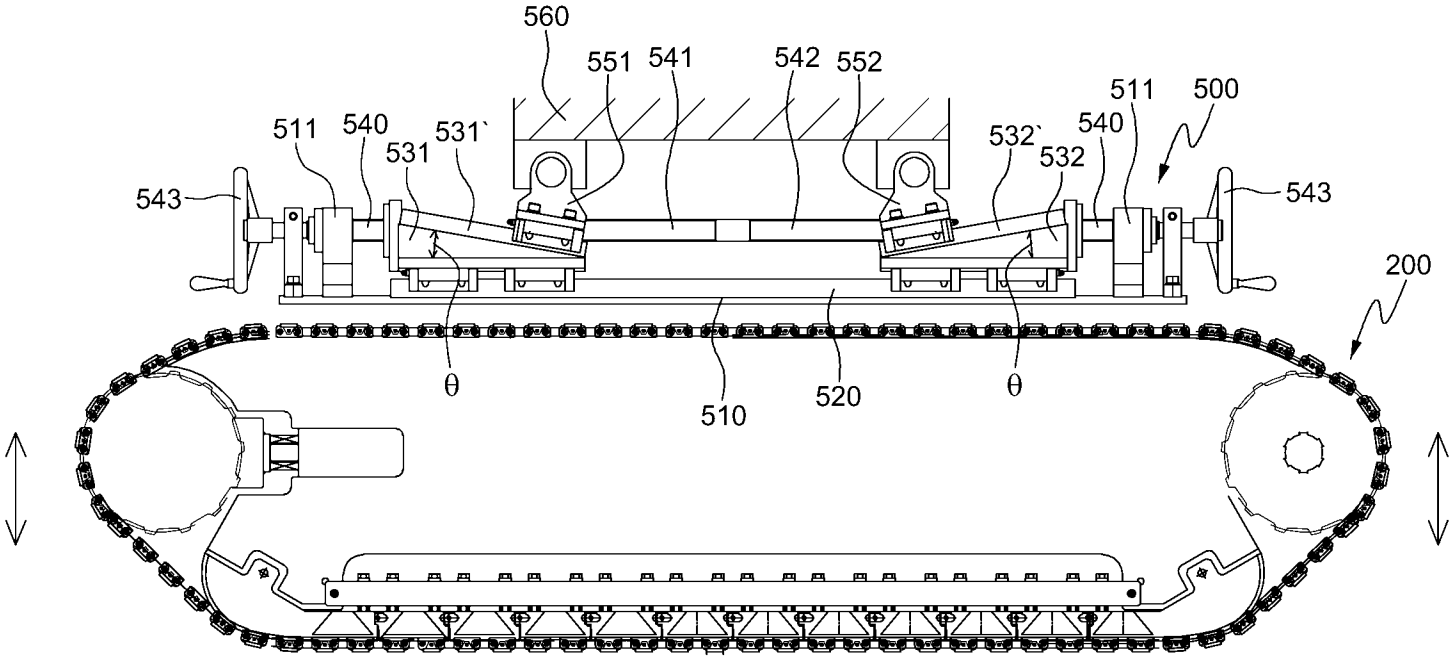
FIG. 14 is a front view showing the structure of a distance adjustment means according to the present invention.
Figure 15:
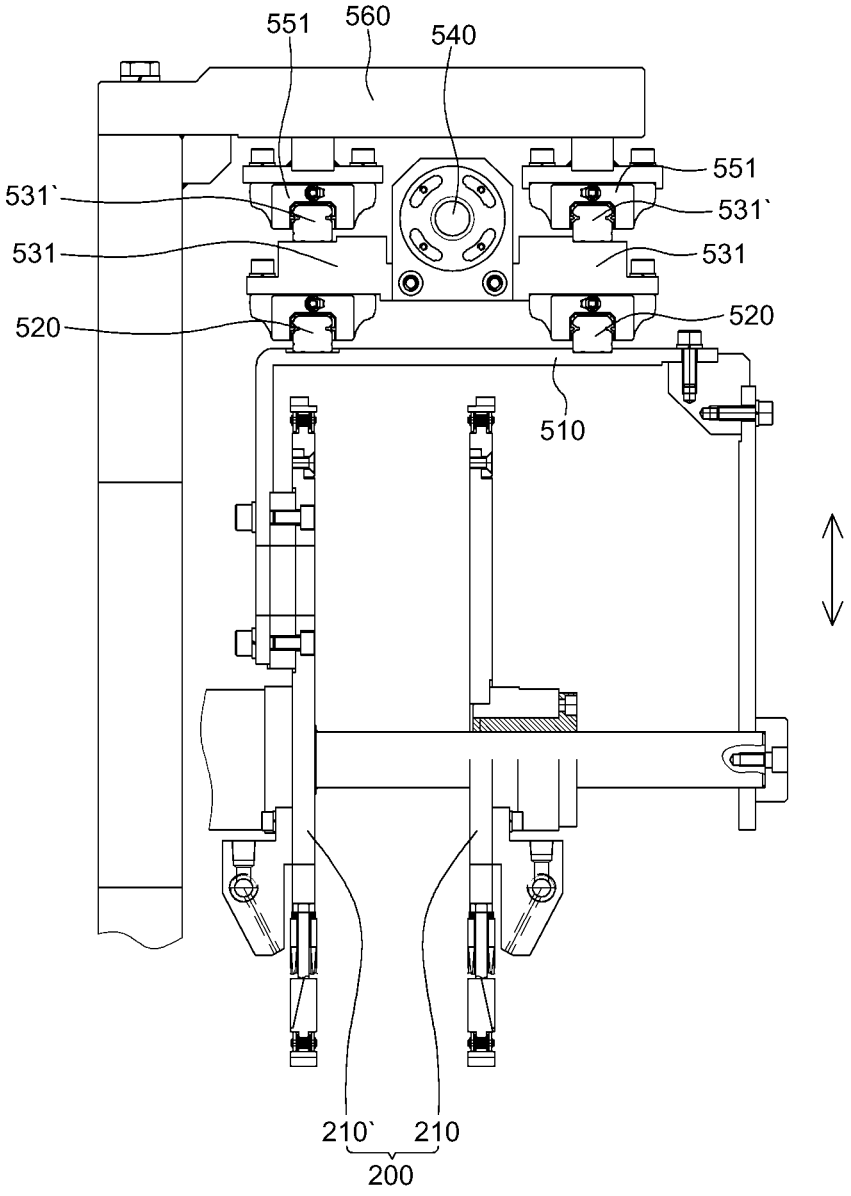
FIG. 15 is a side view showing the structure of the distance adjustment means according to the present invention.

FIG. 14 is a front view showing the structure of a distance adjustment means according to the present invention. FIG. 15 is a side view showing the structure of the distance adjustment means according to the present invention.

If it is required in a separate operation to grind compression lines springs having a different dimension, the distance between the first Support block 115 and the second Support block 215 must be adjusted to correspond to the outer diameter of the compression line springs.

The distance adjustment means 500 for adjusting the distance between the first and second support blocks 115 and 215 includes a lift frame 510 includes a lift frame 510, a rail 520, inclined blocks 531 and 532, a fifth screw shaft 540, and fixed blocks 551 and 552.

The lift frame 510 is coupled to the upper chain conveyor 200 and configured to move upward or downward along with the upper chain conveyor 200.

The lift frame 510 has a reverse U shape that is open on a lower end thereof. An upper end of the upper chain conveyor 200 is inserted into the lift frame 510.

The rail 520 extends in the left-right direction on an upper end of the lift frame 510. FIG. 15 illustrates the structure in which two rails 520 are spaced apart from each other by a predetermined distance and installed parallel to each other.

The inclined blocks 531 and 532 are coupled to the rails 520 and configured to move along the rails 520. Inclined rails 531' and 532' having a predetermined inclination angle θ are respectively installed on the inclined blocks 531 and 532.

In this embodiment, the two inclined blocks 531 and 532 are provided. The two inclined blocks 531 and 532 are installed on the rails 520 and configured to form a symmetrical structure facing each other at positions spaced apart from each other by a predetermined distance.

The fifth screw shaft 540 is installed to pass through the two inclined blocks 531 and 532 coupled to the rails 520 and is rotatably coupled to a support 511 installed on the lift frame 510.

The fifth screw shaft 540 includes a left-handed screw part 541 that is formed on one side of the fifth screw shaft 540 based on a medial portion thereof, and a right-handed screw part 542 that is formed on the other side thereof. Any one of the inclined blocks 531 is coupled to the left-handed screw part 541, and the other inclined block 532 is coupled to the right-handed screw part 542 so that when the fifth screw shaft 540 is rotated, the two inclined blocks 531 and 532 are moved toward or away from each other.

In this embodiment, the two fixed blocks 551 and 552 are respectively coupled to the inclined blocks 531 and 532. The fixed blocks 551 and 552 are fastened to a fixed frame 560 such that the fixed blocks 551 and 552 are disposed vertically above the respective inclined blocks 531 and 532.

In this way, the fixed blocks 551 and 552 installed on the fixed frame 560 are coupled to the inclined rails 531' and 532' provided on the inclined blocks 531 and 532.

Therefore, when the operator rotates a handle 543 provided on the fifth screw shaft 540, the two inclined blocks 531 are moved toward or away from each other depending on the direction in which the handle 543 is rotated. During this process, the two inclined blocks 531 and 532 are moved upward or downward by the inclined rails 531' and 532' and the fixed blocks 551 and 552 and thus move the lift frame 510 upward or downward. Then, the upper chain conveyor 200 is moved upward or downward by the vertical movement of the lift frame 510, whereby the distance between the first Support block 115 and the second Support block 215 can be adjusted.

A method for grinding compression line springs using the grinding apparatus according to the present invention having the above-mentioned construction includes: operation S110 of adjusting both the distance between the front chain unit 110 and the rear chain unit 110' of the lower chain conveyor 100 and the distance between the front chain unit 210 and the rear chain unit 210' of the upper chain conveyor 200 depending on the length of the compression line springs to be ground; operation S102 of adjusting the height of the upper chain conveyor 200 depending on the outer diameter of the compression line springs; operation S110 of seating the compression line springs in the V-shaped depressions 115*a* of the corresponding first support block 115 provided in the lower chain conveyor 100, compressing upper portions of the compression line springs seated on the first support blocks using the planar lower surfaces 215*a* of the second support blocks 215 provided in the upper chain conveyor 200 so as to fix the compression line springs in place, and then transferring the compression line springs in the horizontal direction using the lower chain conveyor 100 and the upper chain conveyor 200; and operation S120 of grinding, using the grinding units 300, the seat surfaces formed on the opposite ends of the compression line springs that are being transferred in operation S110.

In operation S101, both the distance between the front chain unit 110 and the rear chain unit 110' of the lower chain conveyor 100 and the distance between the front chain unit 210 and the rear chain unit 210' of the upper chain conveyor 200 are adjusted depending on the length of the compression line springs to be ground.

In other words, when it is required to grind compression line springs having a different dimension, for example, a different length, the front chain units 110 and 210 are moved and set to positions corresponding to the length of compression line springs to be ground so that the first support block 115 and the second support block 215 can support the compression line springs at appropriate positions.

The movement of the front chain units 110 and 210 may be embodied by the operator in such a way that the operator directly rotates the first screw shafts 130 and 130' provided in the lower chain conveyor 100. Alternatively, it may be embodied by the operation of the motor 250 connected to the second screw shaft 230.

Operation S102 is conducted to grind other compression line springs with a different diameter. When the operator rotates the handle 543 provided on the fifth screw shaft 540, the inclined blocks 531 and 532 are moved by the rotation of the fifth screw shaft 540. Then, the inclined blocks 531 and 532 are slowly moved downward or upward by the fixed blocks 551 and 552 and the inclined rails 531' and 532', whereby the height of the upper chain conveyor 200 can be adjusted.

Operation S102 may be combined with operation S101 or may be alternatively conducted before or after operation S101.

In operation S110, the compression line springs 10 are seated on the first support blocks 115 provided in the lower chain conveyor 100, and then the lower chain conveyor 100 and the upper chain conveyor 200 are operated.

Such operation S110 preferably includes supplying compression line springs from a separate compression-line-spring supply apparatus to the first support blocks 115 while the lower and upper chain conveyors 100 and 200 are operated.

A well known robot arm or a well known automatic part feeder may be used as the compression-line-spring supply apparatus.

Meanwhile, the compression line springs seated on the first support blocks 115 of the lower chain conveyor 100 are moved by the operation of the lower chain conveyor 100. After the compression line springs have moved a predetermined distance, upper portions thereof are compressed by the second support blocks 215 provided in the upper chain conveyor 200. Thereby, the compression line springs can be stably fixed in place by the first and second support blocks 115 and 25.

As such, during the process of using the first and second support blocks 115 and 215 to fix the compressing line springs in place and move them, the compression blocks 260 compress the chain 214 at a predetermined pressure corresponding to conditions of the compression line springs. Thereby, the second support blocks 215 can reliably come into close contact with the compression line springs. Here, the conditions of the compression line springs may include a state whereby the compression line springs are seated on the first support blocks 115, or a deviation in the outer diameter of the compression line springs.

In operation S120, the compression line springs are moved by the operation of the upper and lower chain conveyors 200 and 100 and thus successively pass via the grinding units 300, whereby the seat surfaces formed on the opposite ends of the compression line springs are ground.

Before operation S120 is conducted, the operator rotates the third screw shaft 350 or the fourth screw shaft 380 and thus adjusts the position of the grinding unit 300, thereby adjusting the depth of cut.

As described above, in the apparatus and method for grinding compression line springs according to the present invention, when it is required in a separate operation to grind compression line springs having a different dimension, appropriate conditions for grinding the compression line springs can be easily embodied by simple setting manipulation. Therefore, the efficiency of the operation of grinding compression line springs can be enhanced.

Furthermore, while the first support block 115 and the second support block 215 that face each other fix the compression line springs in place, even if each second support block 215 is not precisely disposed vertically above the corresponding first support block 115, the compression line spring can be stably fixed in place. Therefore, there is no need for precisely processing or setting parts such as the support blocks and the chain related to the support blocks.

Although the embodiment of the present invention has been disclosed for illustrative purposes, it will be appreciated that the present invention is not limited thereto, and those skilled in the art will appreciate that various modifications, additions and substitutions are possible, without departing from the scope and spirit of the invention.

What is claimed is:

1. An apparatus for grinding a compression line spring, comprising:

a lower chain conveyor including a pair of first chain units facing each other at positions spaced apart from each other, wherein each of the first chain units comprises a plurality of first support blocks for supporting compression line springs, each of the first support blocks having a V-shaped depression formed in a top side thereof such that one of the compression line springs is seated onto the V-shaped depression, and a first coupling part provided in a bottom side thereof and having a first through hole, a plurality of first chain links for coupling the first support blocks, each of the first chain links having a first seating depression into which a lower end of corresponding one of the first support blocks is partially inserted, and a plurality of first connection pins, each of the first connection pins being inserted into the through hole of the first coupling part and passing through one of the first chain links, whereby said each of the first support blocks is rotatable around each of the first connection pins within a range allowed by a clearance formed between said each of the first support blocks and said each of the first chain links;

an upper chain conveyor including a pair of second chain units facing each other at positions spaced apart from each other, wherein each of the second chain units comprises a plurality of second support blocks for compressing downward upper portions of the compression line springs seated on the first support blocks, each of the second support blocks having a planar structure, and a second coupling part provided in an upper side of the planar structure and having a second through hole, a plurality of second chain links for coupling the second support blocks, each of the second chain links having a second seating depression into which the upper side of the planar structure is partially inserted, and a plurality of second connection pins, each of the second connection pins being inserted into the second through hole of the second coupling part and passing through one of the second chain links, whereby said each of the second support blocks is rotatable around each of the second connection pins within a range allowed by a clearance formed between said each of the second support blocks and said each of the second chain links; and a plurality of grinding units for grinding seat surfaces formed on opposite ends of the compression line springs that are moved by the lower chain conveyor and the upper chain.

2. The apparatus of claim 1, wherein a first interval between the pair of first chain units is adjustable depending on a length of the compression line springs, and a second interval between the pair of second chain units is adjustable depending on the length of the compression line springs.

3. The apparatus of claim 2, wherein the pair of first chain units are coupled to each other by one or more first screw shafts and first transfer nuts, and the first screw shafts are horizontally extending through the pair of first chain units, and the pair of second chain units are coupled to each other by a second screw shaft and a second transfer nut, and the second screw shaft is horizontally extending through the pair of second chain units, and the first screw shafts and the second screw shaft are connected to each other by a belt and interlocked with each other.

4. The apparatus of claim 3, wherein the second screw shaft is connected to a motor and rotated by operation of the motor.

5. The apparatus of claim 1, further comprising:

a plurality of compression blocks provided in the upper chain conveyor and pressing the pair of second support blocks downward so that the second support blocks are brought into close contact with the compression line springs; and a plurality of springs installed in the upper chain conveyor and elastically supporting the compression blocks.

6. The apparatus of claim 5, wherein the plurality of compression blocks are coupled to each other by a pin plurality of pins.

7. The apparatus of claim 1, further comprising:

a distance adjustment means for moving the upper chain conveyor upward or downward and adjusting a distance between the first support blocks and the second support blocks.

8. The apparatus of claim 7, wherein the distance adjustment means comprises:

a lift frame coupled to the upper chain conveyor;

a pair of rails installed on an upper side of the lift frame and extending in parallel with the pair of second chain units;

a pair of inclined blocks provided so as to be movable along the rails and including inclined rails installed on upper ends of the pair of inclined blocks, respectively;

a screw shaft configured to pass through the pair of inclined blocks and rotate by a handle for moving the pair of inclined blocks such that the pair of inclined blocks move toward or away from each other; and a pair of fixed blocks installed on a fixed frame and coupled to the inclined rails, respectively, wherein when the inclined blocks are moved, the fixed blocks guide the inclined blocks to move upward or downward by an inclination angle of the inclined rails.

9. The apparatus of claim 1, further comprising:

a motor providing power for driving the lower chain conveyor and the upper chain conveyor;

a reducer connected to the motor and including output shafts;

a first universal joint connecting a first output shaft to a first spline shaft extending from the lower chain conveyor; and a second universal joint connecting a second output shaft to a second spline shaft extending from the upper chain conveyor.

10. The apparatus of claim 1, further comprising:

a transfer table;

a plurality of grinding units installed on an upper surface of the transfer table;

a first transfer nut fastened to a lower surface of the transfer table; and a first screw shaft coupled to the first transfer nut and configured to move the first transfer nut and the transfer table toward or away from the compression line springs.

11. The apparatus of claim 10, further comprising:

a fastening plate installed on a lower end of each of the grinding units;

a second transfer nut installed under a lower surface of the fastening plate; and a second screw shaft installed on the transfer table and coupled to the second transfer nut, the second screw shaft being configured to transfer the second transfer nut.

* * * * *